United States Patent [19]

Maxwell

[11] 4,116,571

[45] Sep. 26, 1978

[54] DISPOSABLE FLUID DISPENSER

[76] Inventor: David Maxwell, 6035 Broadway, New York, N.Y. 10471

[21] Appl. No.: 742,633

[22] Filed: Nov. 17, 1976

Related U.S. Application Data

[63] Continuation-in-part of Ser. No. 680,900, Apr. 27, 1976, abandoned.

[51] Int. Cl.[2] ..... B43K 5/18; B43M 11/06; A47L 13/30

[52] U.S. Cl. ..... 401/264; 401/206

[58] Field of Search ..... 401/264, 269, 265, 260, 401/278, 186, 206, 273, 279; 222/501, 518

[56] References Cited

U.S. PATENT DOCUMENTS

| | | | |
|---|---|---|---|
| 1,608,570 | 11/1926 | Tuggle | 401/264 |
| 3,481,678 | 12/1969 | Schwartzman | 401/264 X |
| 3,663,113 | 5/1970 | Frain et al. | 401/206 |

*Primary Examiner*—Stephen C. Pellegrino

*Attorney, Agent, or Firm*—Kane, Dalsimer, Kane, Sullivan & Kurucz

[57] ABSTRACT

A dispenser adapted for use in personal application of viscous liquid. The dispenser includes a hollow container for the liquid and valve structure on the container. The valve is automatically shiftable by actuation of an exterior portion thereof to bias a spring structure and permit flow of the viscous liquid to the person. The spring structure is designed so that a substantially uniform opening is provided to facilitate uniform dispensing of viscous liquid such as a lotion. For this purpose, the spring structure includes a plurality of spaced spring stems which act in concert to submit uniformly to pressure in opening of the valve and to substantially uniformly close the valve when the pressure is released. In another form, the dispenser is designed for application of flavoring to a product such as a cigarette and the valve actuator is positioned in relation to a guide so that a product end can be guided into engagement with the actuator to open the valve and permit flavoring contained within the dispenser container to be applied to the product.

10 Claims, 7 Drawing Figures

DISPOSABLE FLUID DISPENSER

CROSS REFERENCE TO RELATED APPLICATION

This application is a continuation in part of my previously filed application Ser. No. 680,900 filed Apr. 27, 1976 now abandoned, for DISPOSABLE FLUID DISPENSER, the contents of which are incorporated herein by reference.

BACKGROUND OF THE INVENTION

Numerous types of disposable containers and applicators for fluid materials are available on the market today. For example, as disclosed in connection with the above referenced related application, a disposable inexpensive and simple automatic dispenser is provided for erasing fluid used in eradicating indica applied by a conventional marker. Simple inexpensive structures similar to that system is believed to be useful for a variety of different types of disposable container and dispenser systems. For example, the structure as developed in the present application are adaptable for use with a lotion or other viscous fluid and is a dispenser for a liquid flavoring for products such as cigarettes, respectively.

The present mass market for these types of products evidences the need for the development of a disposable container and dispensing structure to facilitate their use.

For instance, development of novel and revolutionary polymer shaving lotions pose some physical and psychological problems that seriously influence acceptance and adversely affect marketing potential.

Presently available shaving lubrication delivery systems were designed for lathers. They are uneconomically inefficient for polymer lotions. Furthermore, they are psychologically unacceptable for introduction of a new concept in shaving.

Accordingly, there is room for the development of a lotion valve spreader as a tool that takes full advantage of polymer lotions physically and psychologically commensurate with the novelty of the material to make an integrated marketable product.

Aerosols are ideal means of delivering foaming lathers. This is not needed for latherless polymer lotions. The active ingredient versus the propellant ratio is very uneconomical.

Finger pumps cannot be used to apply liquids or cream directly to the face. They can only be used by first getting their contents on the hand and then transferring the lotion or cream to the face. With this criteria, it would be just as simple to pour the contents from the bottle to the hand directly.

Of course, it is very difficult to gauge the amount of any liquid poured into the hand from a bottle. This is especially true when one has just arisen early in the morning.

Transferring a liquid from hand to face without some loss is almost unavoidable. At best, the lotion remaining on the hand is almost equal to the amount needed on the face. This of course is very uneconomical ratio of product use, that is 50%.

Another type of applicator presently available is a sponge which is a good spreader of liquids or fluids. However, a sponge is also a filter. In use with polymer lotions, it would filter out some of the suspended polymers from the shaving lotion. Continued use would increase this filtering effect and would destroy the carefully balanced ratio between liquid and polymer. Furthermore, unless it were constantly capped, the liquid in the sponge would be lost by evaporation.

It should also be kept in mind that lotions must be shaken prior to use in order to distribute the suspended polymers uniformly. There is no way to shake up the liquid in the sponge from a previous application. Also, the sponge cannot be washed and dried without washing out the enormous amount of lotion it contains.

In dealing with human beings, it should be noted that a sponge picks up and retains facial grease and other materials which would be redeposited on the face in subsequent uses which of course is unacceptable and an unsanitary condition.

A final type of prior art applicator which should be kept in mind is a rolling ball type of device. This presents difficulties when dealing with viscous fluids such as skin lotions. For example, the ball must be very accurate with respect to its seat which adds expense in manufacture. The channel between the ball and its seat or retainer must be very narrow to get the required capillary feed and also to prevent ball wobble which provides uneven feed and to keep content loss by leakage and/or evaporation.

It should also be kept in mind that the zone of application even on a large ball is comparatively small due to the tangential effect. It would take an unacceptably long time to cover a large area like the face, therefore drying of the applied lotion on the face would be almost unavoidable. Of course, if the ball sticks by the drying of the lotion or the settling of the suspended polymers in the small passageway between the ball and retainer, it would be difficult to get it rolling again.

With the above presently known devices in mind, it is readily apparent how there is a need and use for a newly developed dispenser for lotions which will overcome the difficulties discussed above.

Additionally, it has become a practice to apply cigarette flavorings directly to the cigarette or its filter end by the smoker immediately prior to smoking the article. Accordingly, an automatic valve dispenser which will permit the storage of a predetermined amount of tobacco flavoring liquid and which can be easily applied to the end of the cigarette to automatically dispense a desired amount of flavoring to the cigarette in a quick and automatic fashion would be extremely desirable. Naturally the device should be disposable and inexpensive in manufacture and use.

SUMMARY OF THE INVENTION

With the above background in mind, it is among the primary objectives to provide a dispenser for viscous liquids such as lotions for personal use which avoids the above discussed difficulties and disadvantages and which is disposable, inexpensive to manufacture, and easy to use. Furthermore, it is also among the primary objectives of the present invention to provide a dispenser for cigarette or other product flavorings which is of low cost in manufacture and easy to use and which can be quickly and efficiently applied to the end of a product to automatically dispense a predetermined amount of flavoring to the product and which can be used repeatedly on products with automatic valving structures opening and closing as the dispenser is applied to the products in sequence.

The heart of the viscous liquid or lotion valve spreader is an automatic acting plastic piston. Six prongs of a resilient nature are partially compressed by a compression cap to bias a valve member into the seated position to maintain the lotion in a dispenser or container. Pressing on an exposed end of the piston automatically unseats the valve and releases the lotion for flow from the dispenser past the exposed end of the valve. The valve has a textured end which assists in spreading the lotion on the skin of the user. Removing the dispenser from the skin automatically permits the valve member to reseat under the force of the valve springs thereby preventing further flow of the contents from the dispenser. Thereafter, passing the dispenser tip under an open faucet, cleans the exposed tip of the valve piston without any water flowing past the seated valve piston and degrading the contents of the dispenser. Furthermore, the spring valve is designed so that it provides for uniform force in the seating and unseating directions so that a uniform opening is provided for passage of the lotion from the container to the user.

It is contemplated that the present dispenser can be used for applying any lotion, like a deodorant, emollient, depillitory, and the like. The type of lotion under consideration is one in which a colloidal suspension of non-soluble ingredients exists.

It is also among the objectives of the present invention to provide a dispenser which is adapted for automatically applying flavoring to the end of a cigarette or similar products with appropriate guide means for directing the end of the cigarette into communication with an exposed portion of the valve part of the dispenser. Thereafter further direction of the cigarette will press the valve and open the passageway for flow of flavoring from the dispenser to the cigarette. When the cigarette is removed, the pressure on the exposed portion of the valve is released and the valve will again seat preventing flow from the dispenser until it is desired to use the dispenser again with a further cigarette.

In summary, the embodiments directed to the dispenser for viscous liquids for personal use includes a hollow container having an opening at the forward end and means thereon to permit introduction of a supply of viscous liquids to the interior of the container. Valve means is adapted to be positioned on the container normally closing the opening in the container and adapted to be opened to release liquid. The valve means includes a valve housing which is hollow and open at both ends. The housing is adapted to be mounted in the opening in the container so that the passageway through the housing provides communication between the interior of the container and the exterior thereof. A valve seat is formed in the housing. A valve piston is movably mounted in the housing and shiftable between a position in engagement with the valve seat to close the opening at the forward end of the container and a position removed from the valve seat to permit the viscous liquid to flow from the container through the opening therein. Spring means is provided in the form of a plurality of substantially uniformaly spaced stems extending rearwardly from the piston. Spring retention means is provided to engage with the stems and normally bias the spring stems to maintain the piston in engagement with the valve seat. The piston in the seated position has an exposed portion extending beyond the housing whereby a predetermined application of force will unseat the piston by applying a further bias to the spring stems and thereby permitting the viscous liquid to flow from the container. Thereafter, release of the predetermined application of force will permit the piston to again seat and close the flow path from the container. The spacing of the spring stems facilitate a uniform unseating of the piston and a consequent uniform flow of viscous liquid from the container.

The embodiments dealing with the product flavoring dispenser include a hollow container having an opening at the forward end and means thereon to permit introduction of a fluid supply of flavoring to the hollow container. Valve means is on the container normally closing the opening in the container and adapted to be opened to release fluid. The valve means includes a movable valve member including an elongated resilient spring stem communicating with a valve plunger and a valve actuator. The stem is normally compressed within the container so as to direct the valve plunger in position against a valve seat to close the opening in the container with the valve actuator extending out of the container. Activation of the valve actuator further biases the stem and unseats the valve plunger and permits fluid to flow from the container. Deactivation of the activator permits the valve plunger to again seat and close the opening in the container. Guide means extends from the container and surrounds the valve actuator. The guide means is adapted to receive the end of the product therein and guide it into engagement with the valve actuator so that insertion of the product will automatically unseat the valve plunger and permit fluid to enter the adjacent end of the product. Removal of the product thereafter will automatically permit the plunger to reseat.

With the above objectives among others in mind, reference is made to the attached drawings.

DESCRIPTION OF THE PREFERRED EMBODIMENT

Figure 1:
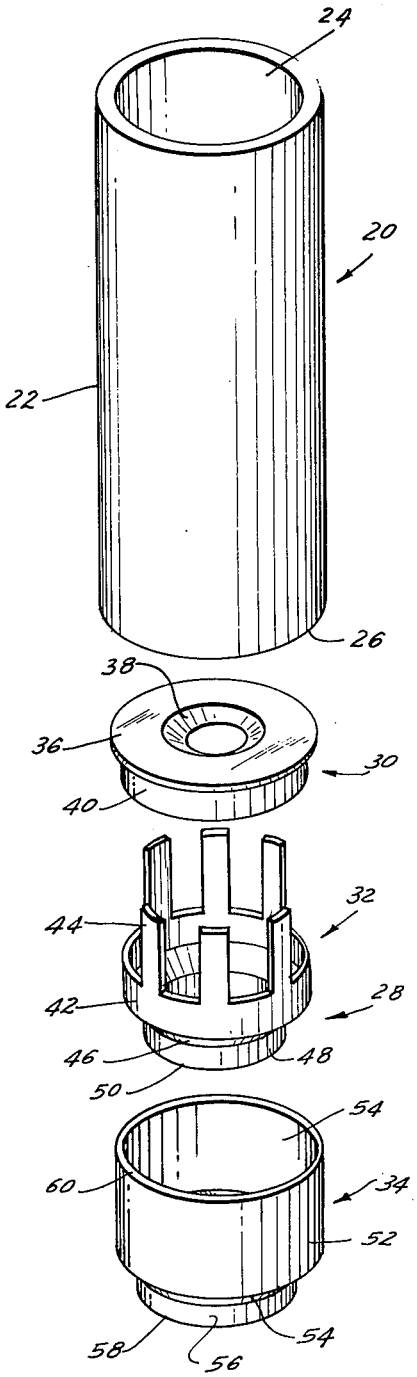
FIG. 1 is an exploded perspective view of a viscous liquid dispensing embodiment of the invention.
Figure 2:
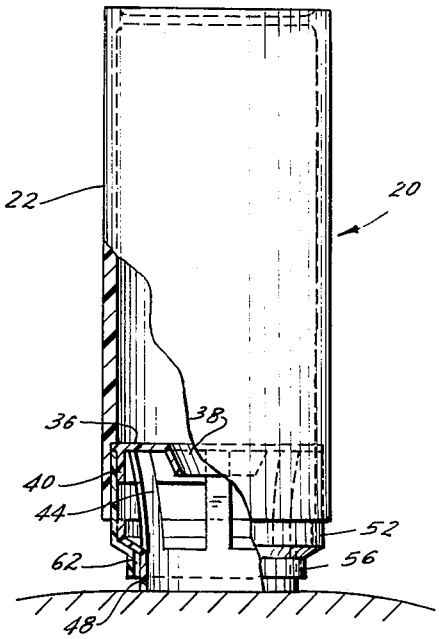
FIG. 2 is a partially sectional elevation view thereof showing the dispenser in engagement with an application surface prior to unseating of the valve.

One form of viscous lotion dispenser or spreader 20 is depicted in FIGS. 1 and 2. The dispenser includes a main container body portion 22 with a closed rear end 24 and an open forward end 26 through which the viscous fluid is introduced to the main container body portion 22 during assembly. Naturally, it is also possible to provide a closure at the closed rear end 24 which can be applied to the container after the container is filled from the rear end. The remainder of dispenser 20 is in the form of a valve assembly 28. The valve assembly includes a valve compressing cap 30, a valve piston 32, and a valve housing 34.

Outer compression cap 30 has a cylindrical base 36 with a central aperture 38 for passage of the viscous liquid therethrough. The base 36 has an annular skirt 40 extending downwardly from the lower surface thereof and the skirt has a lesser outer diameter than the outer diameter of the base 36. The outer diameter of base 36 is slightly less than the inner diameter of main container portion 22 so that the compression cap can be frictionally slid therein. The cap is constructed of a rigid conventional plastic material such as polyethylene, polypropylene or other thermoplastic of thermosetting resin.

The valve piston 32 is hollow and is provided with a central circular base 42. Extending rearwardly from the base are six-spaced valve spring stems 44. The number of stems is a matter of choice. The stems are substantially uniformaly spaced about the periphery of the circular base. Extending forward of the circular base 42 is a fustroconical portion 46 which terminates in an annular projecting actuator portion 48. The end surface 50 of the exposed actuator portion 48 is roughned to facilitate carrying released viscous lotion by capillary action. Additionally, the end surface 50 is very thin, like a membrane, to adapt intself to local skin surface irregularities to facilitate smooth application of the viscous liquid or lotion. Piston 32 is formed of a flexible plastic material such as polyethylene or any conventional substitute therefor.

Valve housing 34 is of a rigid plastic material which can be of a similar type as that utilized for compression cap 30. The housing includes a hollow circular portion 52 with an opening 54 at the rear end. The forward end of circular portion 52 communicates with a fustroconical portion 54 conforming in taper to the frustroconical portion 46 of piston 32. Fustroconical portion 54 terminates in a circular rim 56 of lesser diameter than circular main body portion 52. An opening 58 is present at the bottom for extension of projecting portion 48 of the piston 32 therethrough.

In assembly, piston 32 is inserted into housing 34 with the inner surface of fustroconical portion 54 forming a valve seat for the fustroconical portion 46 of the piston. Projecting portion 48 extends beyond circular portion 56 through opening 58 where it is in position for access to operate the valve. The stems 44 extend beyond the upper rim 60 of main circular portion 52 of the housing and are captured by compression cap 30 which is frictionally seated in housing 52. This is accomplished by engagement between the outer surface of portion 40 of the cap and the inner surface or portion 52 with the under surface base 36 seating on rim 60 of the portion 52. Once seated, the spring stems 44 are slightly compressed by engagement with the under surface of base 36 as depicted in FIG. 2. This biasing force serves to seat fustroconical portion 46 on fustroconical portion 54 and prevent passage through the valve assembly 28 from the opening 38 in the top of cap 30 through the opening 58 in the bottom of housing 34.

The container main portion 22 can then be filled with the viscous fluid and the valve assembly inserted into the bottom end 26 of the container thereby sealing the container and preventing exit of the viscous liquid until actuation of the valve assembly to open the valve passageway. An appropriate recess is provided in the walls of container 22 to receive the valve assembly 28 in frictional sealing engagement as depicted in FIG. 2.

Container 52 can be formed of a rigid plastic material of the same conventional type as used for cap 30 and housing 34 of the valve assembly.

In operation, dispenser 20 is applied to a skin surface by engagement of under surface 50 of the piston with the skin. Application of pressure to the container will bias the spring stems 44 further against the compression cap 30 and will permit the unseating of the fustroconical surfaces permitting the viscous lotion or fluid to pass therebetween and out between a clearance 62 provided between the outer surface of portion 48 and the inner surface of skirt 56. The lotion flows downward onto the skin surface and into engagement with the piston applicator surface 50 which serves to carry the released lotion by capillary action over the area of the skin to which the lotion is to be applied. When the treatment is completed, the extra pressure on container 22 can be released and the dispenser removed from contact with the skin surface. This permits the biased stems 44 to return the fustroconical portions 46 and 54 into engagement once again closing off the passageway and preventing further dispensing of lotion. The exposed portion of piston 32 can then be cleaned, if desired, and the dispenser 20 stored for reuse. The stems 44 are uniformaly spaced about the periphery of piston 32 so as pressure is applied there will be uniform biasing of the spring members and uniform movement of the piston with respect to the housing. This facilitates a uniform dispensing of lotion which is extremely desirable when a viscous type of fluid is being dispensed.

Figure 3:
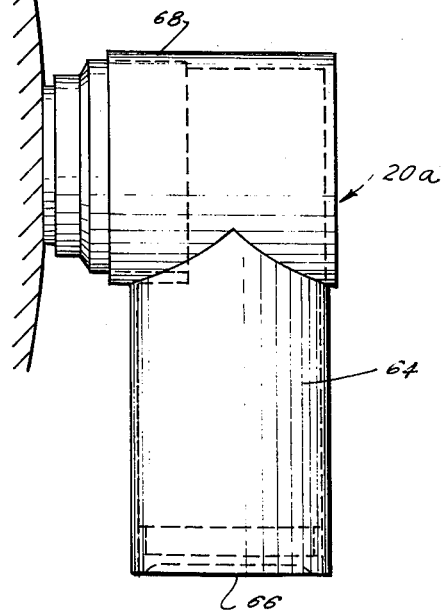
FIG. 3 is an elevation view of an alternative embodiment thereof in engagement with an application surface.

FIG. 3 depicts an alternative embodiment 20*a* of the lotion or viscous fluid dispenser. The difference resides in the configuration of the container assembly. Instead of the main body of the container being cylindrical along its entire length, the body is in the form of an L-shaped two-piece arrangement with the rear end portion 64 being cylindrical and closed by a cap 66 which is applied after the lotion has been introduced into the container to seal the container. The forward portion 68 of the container is frictionally engaged with the rear portion 64 and resides at a right angle with respect thereto. The valve assembly 28 which is identical to that employed in the embodiment of FIGS. 1 and 2 is housed in the forward end of portion 68. In operation, dispenser 20*a* operates in the identical manner as dispenser 20 with the only difference being with respect to the manner in which the dispenser is held during use due to its configuration.

Figure 4:
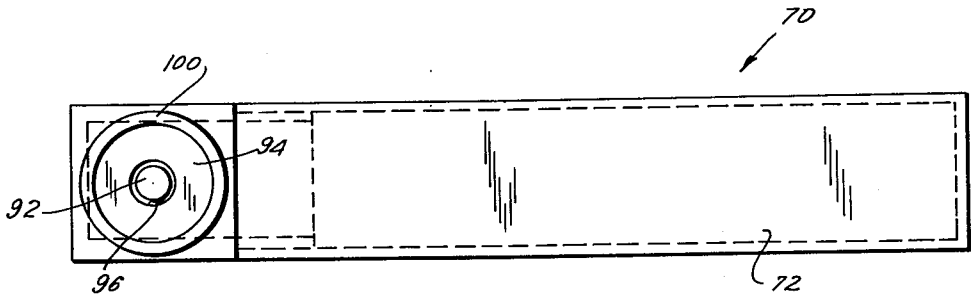
FIG. 4 is a top plan view of an embodiment of the dispenser utilized for dispensing cigarette flavoring.
Figure 5:
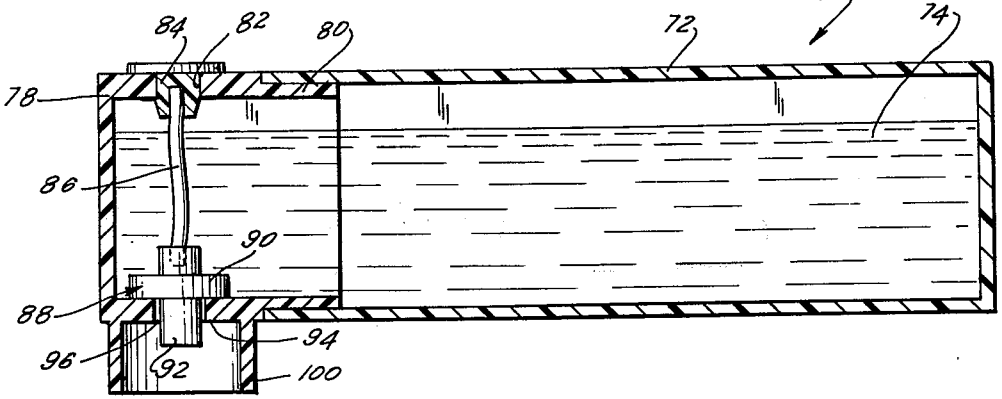
FIG. 5 is a sectional elevation view thereof.
Figure 6:
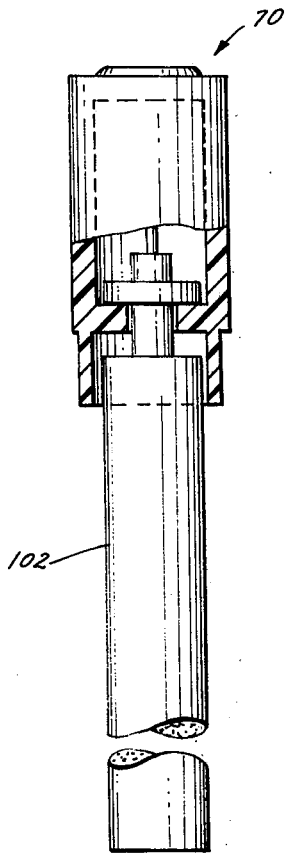
FIG. 6 is a fragmentary partially sectional end view thereof showing a fragmentary portion of a cigarette in position just prior to actuation of the valve to introduce the flavoring.

FIGS. 4–6 depict a further embodiment which is employed as a dispenser for cigarette flavoring liquid. The dispenser is in the form of a cylindrical container with a closed rear portion 72 of conventional plastic material such as an opaque polystyrene. Container portion 72 hold the majority of the flavoring liquid 74. Container portion 72 has an opening 76 at its forward end for coupling with a forward container portion 78. The majority of the length of the forward container portion 78 has an identical outer diameter as portion 72 and the rear end 80 is of reduced diameter so as to frictionally engage with the inner surface of the open end of container portion 72 and permit the forward edge of portion 72 to seat against a receiving shoulder on container portion 78. The result is a tubular container closed at both ends. As shown in FIG. 5, the tobacco flavoring liquid 74 resides in the combined container as formed by portion 72 and 78.

Portion 78 has an aperture 82 in one side wall through which the tobacco flavoring 74 is introduced. A closure or compression cap 84 is then seated in opening 82 to prevent leakage of liquid therethrough and also to form a compression seat for a spring valve stem 86. A suitable recess is provided in the cap 84 to house the end of the spring stem 86. The other end of stem 86 is attached in a conventional manner to a valve plunger 88 which has an intermediate disc portion of larger diameter than a reduced actuator tip portion 92. The tip portion 92 is of smaller diameter than a dispensing aperture 94 in the side wall of portion 78 of the container at a location opposite to opening 82. The outer diameter of actuator portion 92 is less than the opening 94 so as to provide a clearance 96 for the cigarette flavoring to pass through when the valve is unseated. The valve seat is formed by the inner surface 98 of portion 78 adjacent to opening 94 and against which the under surface of disc 90 of valve 88 is pressed by the biasing force of spring stem 86.

Extending laterally from the side wall of portion 78 is a guide means in the form of a circular skirt 100 which is concentrically positioned with respect to actuator 92 and aperture 94. The guide 100 is hollow and is of slightly larger diameter than the end of a cigarette 102 as depicted in FIG. 6 so that the cigarette can be inserted within guide 100 and it will be directed into engagement with actuator 92. Further pressure of the cigarette toward the actuator will depress the actuator further biasing spring stem 86 and unseating valve disc 90 from inner wall 98 of portion 78. This will permit flavoring fluid to flow from the interior of the container through clearance 96 and onto the end of cigarette 102 whether it be in the form of a tobacco end or a filter end. In this manner the flavoring is applied to the cigarette. When sufficient flavoring has been applied, the cigarette is removed and the spring stem 86 will redirect valve disc 90 into sealing engagement with wall 98 once again thereby closing the outlet passage for the fluid and automatically stopping the dispensing action.

As discussed above, rear container portion 72 is of an opaque plastic material such as polystyrene and the forward portion 78 is of a preferred transparent polystyrene or other conventional plastic material. Similarly, closure 84 is also of a rigid conventional plastic such as polystyrene. The valve plunger 88 and stem 86 is formed of a flexible conventional plastic material such as polyethylene.

Figure 7:
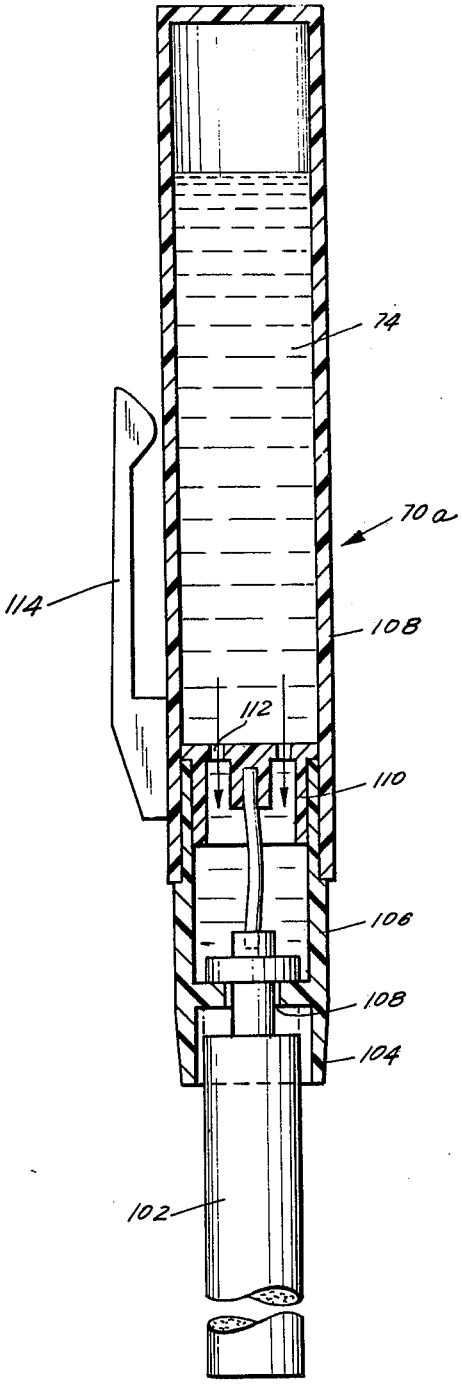
FIG. 7 is an alternative form of the cigarette flavoring dispenser showing a cigarette in position just prior to actuation of the valve to permit dispensing of the flavoring to the cigarette.

An alternate form of the flavoring dispenser **70*a* is depicted in FIG. 7. Instead of the lateral guide-away for the cigarette as in the previous embodiment, an axial guide-way 104 is provided as part of a transparent forward portion 106 of the container which is axially aligned with the rear opaque portion 108. The rear opaque container portion 108 can be filled through an open forward end with the flavoring 74 and the open end can then be closed by the rear end portion of transparent container portion 106. The transparent container portion 106 is provided with a closure 110 which has holws 112 in the upper surface so that the flavoring liquid 74 can pass therethrough and into the forward portion 106 for dispensing purposes. The closure 110 captures the valve stem in the same manner as closure 84 captured the valve stem in the previously discussed embodiment. In fact, when assembled, the valve operates like the valve of the previously discussed embodiment. Cigarette 102 is inserted into guideway 104 and engages with the valve actuator to further bias the valve stem and permit flavoring to pass through the clearance 108 and onto the rear surface of the cigarette 102. Removal of the cigarette will permit the valve to automatically close in the same manner as in the previous embodiment. One other feature of the axially aligned dispenser 70*a* is the provision of a molded clip 114 of plastic or any conventional substitute therefor which permits the dispenser 70*a* to be clipped to a persons pocket when not in use. In this manner, the user can carry the dispenser 70*a* with him and when he wishes to apply flavoring to a cigarette merely remove the dispenser from his pocket, apply the cigarette to the guide-way 104**, and automatically operate the dispenser to flavor the cigarette.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A dispenser for viscous liquids for personal use comprising; a hollow container having an opening at the forward end and means thereon to permit introduction of a supply of viscous liquid to the interior of the container, valve means adapted to be mounted on the container normally closing the opening in the container and adapted to be opened to release liquid, the valve means including a valve housing which is hollow and open at both ends, the housing adapted to be mounted in the opening in the container so that the passageway through the housing provides communication between the interior of the container and the exterior thereof, a valve seat formed in the housing, a valve piston movably mounted in the housing and shiftable between a position in engagement with the valve seat to close the opening at the forward end of the container and a position removed from the valve seat to permit the viscous liquid to flow from the container through the opening therein, spring means in the form of a plurality of substantially uniformly spaced stems extending rearwardly from the piston, spring retention means to engage with the stems and normally bias the spring stems to maintain the piston in engagement with the valve seat, and the piston in the seated position having an exposed portion extending beyond the housing whereby a predetermined application of force to the exposed portion will unseat the piston by applying a further bias to the spring stems and thereby permit the viscous liquid to flow from the container and, thereafter, release of the predetermined application of force will permit the piston to again seat and close the flow path from the container, and the spacing of the spring stems facilitating a uniform unseating of the piston and a consequent uniform flow of viscous liquid from the container.

2. The invention in accordance with claim 1 wherein the spring retention means includes a compression cap engaged with the housing in position to bias the spring stems, and the compression cap having an aperture therein for passage of the viscous liquid from the container therethrough and into the valve housing.

3. The invention in accordance with claim 1 wherein the means for introducing a supply of viscous fluid to the interior of the container includes an opening in the rear end of the container closed by a force fit non-removable cap after the viscous liquid has been introduced therethrough to prevent leakage of the viscous fluid from the rear end of the container during use.

4. The invention in accordance with claim 1 wherein a predetermined clearance is provided between the outer surface of the piston and the adjacent surface of the housing when the piston is unseated so that the viscous fluid can flow therebetween while being dispensed from the container.

5. The invention in accordance with claim 1 wherein the dispenser is in the shape of an elongated tubular container and valve assembly wherein the viscous liquid is housed in the rear end of the container and is dispensed through the forward end of the container adjacent the forward end of the piston.

6. The invention in accordance with claim 1 wherein the dispenser is L-shaped in configuration with the rear portion of the container forming one leg of the dispenser and containing a portion of the viscous liquid therein and the remaining leg of the dispenser containing the valve housing and piston and storing the remaining portion of the viscous liquid.

7. The invention in accordance with claim 1 wherein the components of the dispenser are of a plastic material.

8. The invention in accordance with claim 1 wherein the forward exposed edge of the piston is roughened to facilitate transportation of dispensed viscous fluid by capillary action and the roughened surface being thin so that it is adaptable to local skin surface irregularities.

9. The invention in accordance with claim 1 wherein there are six spring stems extending rearwardly from a cylindrically shaped piston, the stems being uniformly spaced about the circumference of the piston.

10. The invention in accordance with claim 1 wherein the valve housing has a fustroconically shaped intermediate portion connecting a cylindrically shaped rear portion to a cylindrically shaped forward portion of smaller diameter, the piston having a corresponding fustroconical intermediate portion connecting a cylindrically shaped rear portion with a cylindrically shaped forward portion of smaller diameter corresponding to the shape of the interior surfaces of the housing so that the fustroconical portions thereof form valve seating surfaces, the outer surface of the cylindrical portion of the piston being of narrower diameter than the inner surfaces of the corresponding cylindrical portions of the housing so as to permit reciprocal movement of the piston within the housing and to permit flow of the viscous liquid therebetween during the dispensing thereof.

* * * * *